US006626113B1

(12) United States Patent
Gilman et al.

(10) Patent No.: US 6,626,113 B1
(45) Date of Patent: Sep. 30, 2003

(54) LONG RANGE TRAINING CARTRIDGE

(75) Inventors: Stewart Gilman, Budd Lake, NJ (US); Leon R. Manole, Great Meadows, NJ (US); Francis Renner, Stroudsburg, PA (US); Anthony P. Farina, Hackettstown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/217,999

(22) Filed: Aug. 13, 2002

Related U.S. Application Data

(60) Provisional application No. 60/357,562, filed on Feb. 19, 2002.

(51) Int. Cl.[7] ..... F42B 8/02; F42B 10/48

(52) U.S. Cl. ..... 102/444; 102/439; 102/521; 102/529

(58) Field of Search ..... 102/430–434, 102/439, 444, 520–523, 529

(56) References Cited

U.S. PATENT DOCUMENTS 4,029,018 A * 6/1977 Bjornson ..... 102/521
4,142,467 A * 3/1979 Stahlmann et al. ..... 102/522
4,215,632 A * 8/1980 Sie ..... 102/521
4,408,538 A * 10/1983 Deffayet et al. ..... 102/522
4,590,862 A * 5/1986 Grabarek et al. ..... 102/522
4,936,219 A * 6/1990 Mudd ..... 102/522
6,123,289 A * 9/2000 Manole et al. ..... 102/526

FOREIGN PATENT DOCUMENTS

DE 2924041 * 12/1980 ..... 102/521
GB 2243901 * 11/1991 ..... 102/522

* cited by examiner

*Primary Examiner*—Harold J. Tudor
(74) *Attorney, Agent, or Firm*—Michael C Sachs; John F. Moran

(57) ABSTRACT

A long-range training cartridge meets current US Army requirements. The long-range cartridge design enables its sub-projectile to be range limited to less than 8000 meters when fired at a 10-degree gun elevation. The long-range training projectile includes a three-piece aluminum or steel sabot with a similar exterior profile to the kinetic energy tactical sabot. The sabot encapsulates a light-weight sub-projectile comprised of a steel rod and an aluminum fin or cone. Since the sub-projectile is encapsulated in the sabot, it will not be subjected to differential pressures associated with interior ballistic gun gasses. As a result the sub-projectile will therefore have less bending and better flight characteristics. The sub-projectile meets the guidelines for target accuracy and precision at ranges beyond 3000 meters.

16 Claims, 2 Drawing Sheets

LONG RANGE TRAINING CARTRIDGE

This application claims the benefit under 35 U.S.C. 119(e) of U.S. provisional application No. 60/357,562 filed on Feb. 19, 2002.

GOVERNMENT INTEREST

The invention described herein may be manufactured and used by or for the Government of the United States for governmental purposes without payment of any royalties thereon.

FIELD OF THE INVENTION

The invention described herein relates to the field of military ordnance. In particular it relates to large caliber training ammunition fired from tanks in the arsenal of the United States Army.

BACKGROUND OF THE INVENTION

The standard gun on the US Army's main battle tank, the M1A1 Abrams, is a 120 mm smooth bore cannon. This gun is capable of firing a suite of specialized ammunition required on the modern battlefield including high velocity long-rod penetrators, shaped-charged warheads and high explosive rounds. These rounds are inherently lethal, have extremely long ranges and are quite expensive.

For these reasons, the use of these rounds is restricted to the actual battlefield and only the most specialized of training exercise. For general exercises it is advantageous to have training rounds that can emulate the various battlefield ammunition types and incorporate necessary features such as look and feel of the actual device while achieving reduced production costs, reduced range and severely restricted lethality.

Currently, the M865 training cartridge is the Army's standard 120 mm training projectile for kinetic energy (KE) rounds. It is used to emulate a wide range of tank ammunition including the following tactical projectiles: M829, M829A1, M829A2 and M829A3. The M865 projectile design could be further improved to more closely emulate the appropriate physical characteristics of the foregoing and other tactical projectiles.

The M865 training cartridge is substantially shorter (approximately 4 inches) and lighter (approximately 12 lbs) than the tactical cartridges it is intended to emulate. Specifically, U.S. Army Annex E, Long-Range Kinetic Energy Training Ammunition (LRKE)—120 mm Operational Requirements Document (ORD) for Tank Ammunition states the following: The current training kinetic energy ammunition does not emulate the appearance, handling, and accuracy of the service kinetic energy round.

The smaller size and lighter weight of the M865 training cartridge could result in unrealistic training for the soldiers and could promote the development of habits that could be unsuitable for combat situations. In particular, during training, the soldier becomes accustomed to the reduced weight and shorter overall length of the M865 training cartridge and develops loading techniques that do not apply to tactical ammunition. This adversely affects the soldier's ability to perform his job efficaciously and safely when using the tactical ammunition.

Space is very limited inside a tank. A soldier training with an M865 training cartridge and then using a tactical cartridge, to which the soldier has had limited exposure, in battle, could cause the cartridge to impact against portions of the interior of the vehicle, e.g., ceiling or walls. The soldier could inadvertently damage the tip of the tactical projectile affecting its accuracy and ability to defeat the target, or worse, drop the projectile after hitting an unanticipated surface within the tank during the heat of battle.

The current US Army requirement has established that kinetic energy training projectiles fired at all Army Training Facilities worldwide must be on the ground before reaching an 8000-meter limit when fired at a 10-degree gun elevation and be accurate out to 3000 meters. The M865 training cartridge is capable of meeting the 8000-meter requirement, however, the U.S. Army ORD states that the M865 training cartridge cannot be fired accurately beyond 2500 meters.

Thus, there is a great and still unsatisfied need for a solution to the training rounds for 120 mm tank guns or other similar weapons, which addresses the foregoing concerns.

SUMMARY OF THE INVENTION

The long range trainer (LRT) of the present invention satisfactorily meets this need by addressing the shortcomings of the M865 training cartridge and providing a training round that meets all the current US Army requirements. In particular, the long range trainer meets the guidelines for target impact dispersion at ranges beyond 3000 meters, displaying accuracy and round-to-round precision necessary to meet the current requirements.

The long range trainer design enables its projectile to be range limited to less than 8000 meters when fired at a 10-degree gun elevation. In addition, the long range trainer will provide positive training for the soldier by having the similar exterior physical appearance, meeting the weight requirements and being accurate out to 3000 m. It is estimated that the long range trainer will be comparable in cost to the existing trainer (M865).

The long range trainer achieves its goals by incorporating the following characteristics: The physical parameters of the new cartridge more closely duplicate that of the current tactical tank cartridges including the M829, M829A1, M829A2 and M829A3 cartridges. Specifically, the overall cartridge weight of the new trainer is increased and is within the requirements of the ORD. The heavier weight is achieved by utilizing a longer sabot that has a similar profile to the tactical projectile. This sabot can be fabricated from either aluminum or steel. The steel sabot allows a closer weight match to the tactical cartridge and also achieves savings compared to aluminum sabots that are used in the M865 training cartridge.

The overall length of the long range trainer is also increased to be almost identical (or generally similar) to that of the kinetic tactical cartridge, to have an almost identical exterior profile, and to meet the Army weight and profile requirements. These advantages provide positive and proper training to the soldier.

The long range trainer is designed to have a three-piece aluminum or steel sabot with a similar exterior profile to the kinetic energy tactical sabot. The long range trainer sabot is designed to encapsulate and support a light-weight steel rod and aluminum fin or cone. After gun launch, the sabot is discarded and the light-weight projectile (steel rod and aluminum fin) travel downrange to the target. Due to the light-weight of the projectile it does not travel more than 8000 meters without ground impact, when fired from a gun with ten degrees elevation, but has the ability to meet accuracy requirements out to a range of approximately 3000 meters to 4000 meters.

Additionally, as a result of the in-flight projectile being encapsulated at least in part in the sabot, it will not be subject to differential pressures (−dp) and will not have bending problems that most kinetic energy projectile rods have, which cause accuracy problems in-flight. Differential pressures are caused by uneven propellant burning and therefore may bend the projectile rod at shot start that is inside the propellant bed. All the tactical projectiles and the M865 have rods that are inside the propellant bed of the cartridge. Since the long range trainer projectile is not inside the cartridge case it is not subject to this problem.

The long range trainer design also allows for the use of a fin in place of a high drag cone, which will also help with accuracy and dampen any pitch and yaw when the projectile is launched.

In addition, the benefits of the long range trainer are achieved with minimal changes to the current M865 production line. The projectile assembly does not intrude into the cartridge case, allowing less energetic and less expensive M14 propellant versus other conventional kinetic propellant such as JA2 to be used. Therefore, except for the in-bore projectile, all other trainer cartridge components will be the same as the M865. As a result, the cost of the long range trainer is expected to be comparable to, or less than that of the current M865 trainer.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
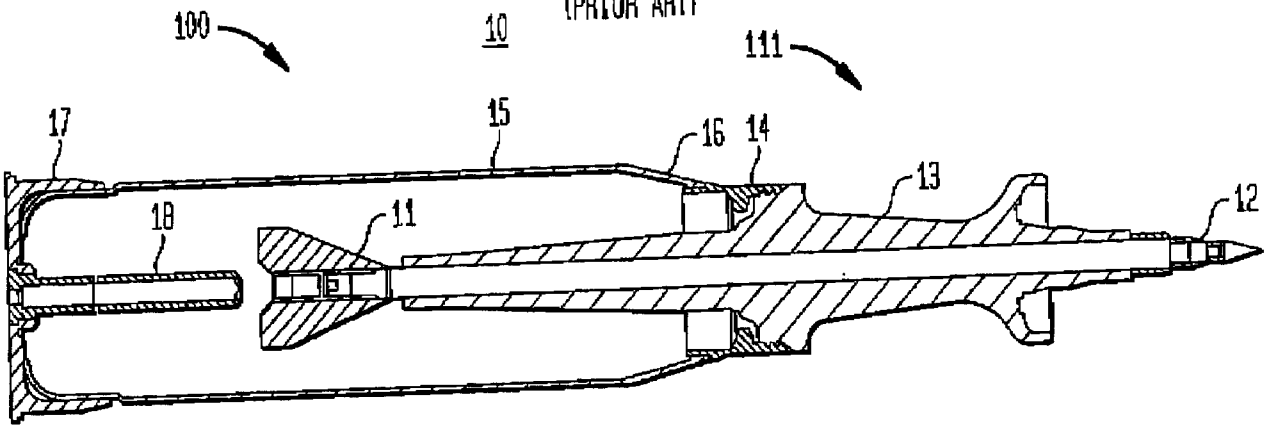
FIG. 1 (PRIOR ART)
FIG. 1 is a cross-sectional, side view of a conventional kinetic energy tactical cartridge.

FIG. 1 is a cut-away profile view of a conventional kinetic energy tactical cartridge 10, such as the M829A2 kinetic energy tactical cartridge. FIG. 1 provides an emphasis on the outer geometry of the cartridge 10 and allows comparison with the length and profile of the M865 training cartridge 20 of FIG. 2 and the long range trainers 30 and 40 of FIGS. 3 and 4, respectively.

The M829A2 kinetic energy tactical cartridge is depicted in FIG. 1. The kinetic energy tactical cartridge 10 is generally comprised of a cartridge assembly 100 and a projectile assembly 111. The projectile assembly 111 includes a plurality of fins 11, a projectile rod 12, a sabot 13, and an obturator 14. The cartridge assembly 100 includes a cartridge case 15, a case adapter 16, a case base and a seal assembly 17, and a primer 18. The tactical cartridge 10 incorporates external features that are required by the ORD for a future kinetic energy tank training round.

Figure 2:
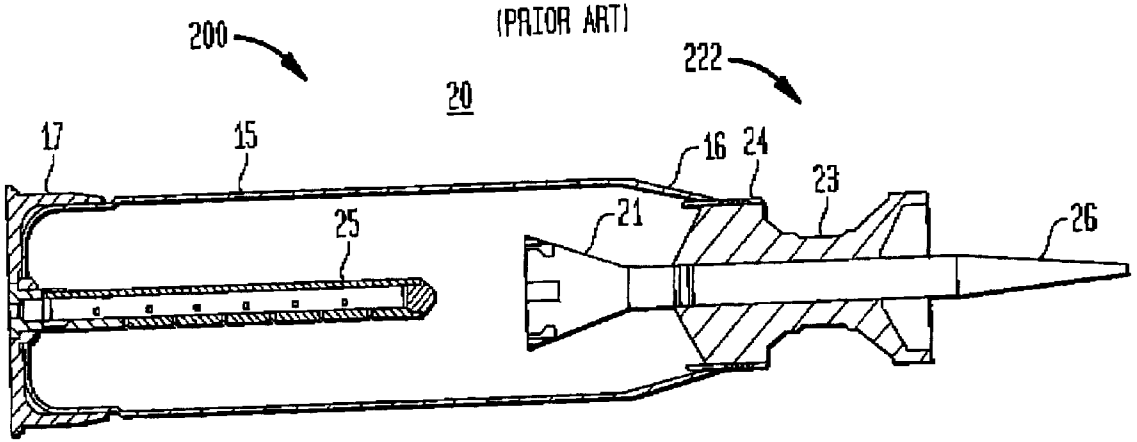
FIG. 2 (PRIOR ART)
FIG. 2 is a cross-sectional, side view of another conventional kinetic energy training cartridge (M865)

FIG. 2 is a cut-away view of a conventional training cartridge 20, such as the M865 training cartridge, for tank kinetic energy tactical cartridges. FIG. 2 provides an emphasis on the outer geometry of the cartridge and allows comparison with the length and profile with the M829A2 kinetic energy tactical cartridge 10 of FIG. 1.

The training cartridge 20 is generally comprised of a cartridge assembly 200 and a projectile assembly 222. The projectile assembly 222 includes a high drag cone 21, a projectile rod 22 secured to a nose 26, a sabot 23, and an obturator 24. The cartridge assembly 200 includes a cartridge case 15, a case adapter 16, a case base and seal assembly 17, and a primer 25. FIG. 2 illustrates that the kinetic energy trainer or cartridge 20 does not meet the external features that are required by the ORD for a future kinetic energy tank training rounds needed (as illustrated in FIG. 1).

Figure 3:
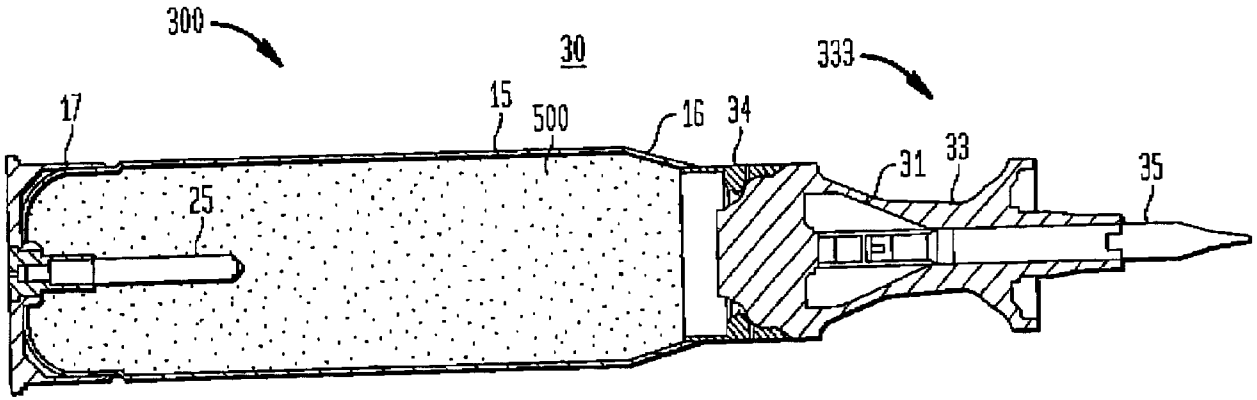
FIG. 3 is a cross-sectional, side view of a long range trainer of the present invention, including a cartridge with standard fins.

FIG. 3 is illustrates a long range trainer (or training cartridge) 30 equipped with a plurality of fins, according to a preferred embodiment of the present invention. FIG. 3 provides an emphasis on the outer geometry of the trainer 30, and allows comparison with the length and profile with the kinetic energy tactical cartridge 10 of FIG. 1.

The training cartridge 30 is generally comprised of a cartridge assembly 300 and a projectile assembly 333. The projectile assembly 333 includes a plurality of fins 31, a projectile rod 32 secured to a nose 35, a sabot 33, and an obturator 34. The cartridge assembly 300 includes a cartridge case 15, a case adapter 16, a case base, a seal assembly 17, and a primer 25.

Figure 4:
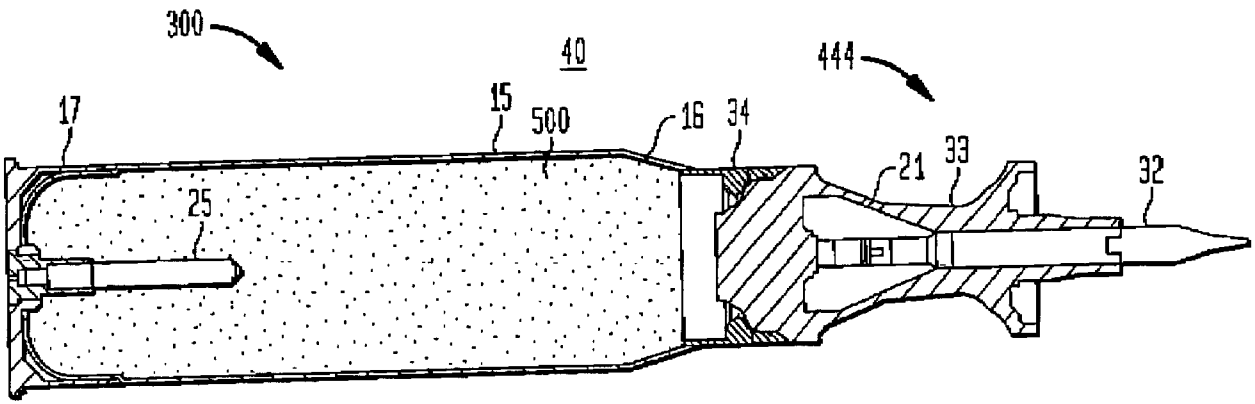
FIG. 4 is a cross-sectional, side view of a long range trainer according to another embodiment of the present invention, including a cartridge with a drag cone.

FIG. 4 illustrates a long range training cartridge 40 that is generally similar in design and function to the training cartridge 30 of FIG. 3, except that its projectile assembly 444 depicts the use of a high drag cone 21 instead of the fins 31. This feature allows for a shorter projectile to use the same cone as the M865 cartridge 30 of FIG. 2, to achieve the 8000-meter range should a higher velocity be required on the training cartridge 30 with high velocity rounds.

The training cartridge 30 or 40 incorporates features that make it an effective kinetic energy training round. Some of these features are presented below.

The weight and length of the overall training cartridge 30 or 40 simulate those of the actual tactical cartridge 10 of FIG. 1.

The external geometry of the overall training cartridge 30 or 40 is almost identical to that of the tactical cartridge 10 of FIG. 1.

The design results in accuracy and precision of the training cartridge 30 or 40 meet the Army's current target impact dispersion requirements.

The low mass of the overall training cartridge 30 or 40 allows it to meet the 8000-meter maximum range requirement.

Utilizing a standard kinetic energy fin 31 or a standard high drag cone 21, allows for cost savings and improved flight stability over conventional 120 mm tank training rounds.

The weight of the training cartridge 30 or 40 has been increased from the conventional training cartridge 20. This is achieved by either a longer and heavier sabot 33, or a heavier case base and a seal assembly 17. Known or available sabots can be used. An exemplary known sabot 33 comprises three petals that have standard kinetic energy threads and/or buttress grooves that support the projectile rod 32 upon gun launch. The sabot petals are discarded after gun launch, and come apart in the air stream, allowing the in-flight projectile (i.e., projectile rod 32 and either the fins 31 or cone 21) to continue down-range to target.

Due to the fact that the sub-projectile (comprised of the projectile rod 32 and either the fins 31 or cone 21) are encapsulated in the sabot 33, the projectile rod 32 and nose 35 of projectile assemblies 333 and 444 can now be shorter than, and have a smaller outer diameter than the projectile assembly 222 of the training cartridge 20 of FIG. 2. This provides a low mass in-flight projectile, i.e., less than 3 lbs, that has enough momentum to fly accurately to the 3000- to 4000-meter targets, but will not fly past the 8000-meter limit at a 10 degree gun elevation due to lack of momentum.

The shorter projectile rod 32 and nose 35 and either the fins 31 or cone 21 of projectile assemblies 333 and 444 will have a significantly greater velocity than the projectile assembly 222 of the training cartridge 20 of FIG. 2, for the same type of propellant (i.e., M14) and charge weight of propellant if an aluminum sabot 33 were used. This allows less M14 propellant to be used in the training cartridge 30 or 40, reducing the overall cost of production. If a steel sabot 33 were used, then the training cartridge 30 or 40 will have a similar amount of propellant to the training cartridge 20 of FIG. 2, but cost saving is achieved by using a steel sabot instead of an aluminum sabot 33.

Additionally, because the in-flight projectile. rod 32 and either the fins 31 or cone 21 are encapsulated in the sabot 33, they will not be subject to differential pressures (−dp), and thus will not have bending problems that most kinetic energy projectile rods have which cause accuracy problems in-flight. The present inventive design also allows for use of fins 31 in place of a high drag cone 21 which will also help with accuracy and dampen any pitch and yaw when the projectile is launched.

Preferably, the cartridge case 15, the case adapter 16, the case base and seal 17, the primer 25, and the propellant 500 are similar to corresponding components of the conventional training cartridge 20 (M865) of FIG. 2. This minimizes impact on production cost and time. In addition, the high drag cone 21, may be used in place of the fins 31, should a high drag projectile be needed.

It should be apparent that many modifications may be made to the invention without departing from the spirit and scope of the invention.

What is claimed is:

1. A kinetic energy training cartridge capable of launching a range limiting sub-projectile having a weight less than 3 pounds, allowing the sub-projectile to not exceed approximately an 8000-meter distance when fired at approximately a 10-degree elevation, and to meet a kinetic energy target dispersion requirement of up to approximately 4000 meters, comprising:

a cartridge assembly; and a projectile assembly secured to the cartridge assembly;

wherein the projectile assembly comprises the sub-projectile and a sabot;

wherein the sub-projectile comprises a plurality of stabilizing fins, a projectile rod, and a nose;

wherein the plurality of stabilizing fins are secured to the kinetic energy projectile rod;

wherein the kinetic energy projectile rod is secured to the nose;

wherein the plurality of stabilizing fins and the kinetic energy projectile rod are completely encapsulated in the sabot, so that the stabilizing fins and the kinetic energy projectile rod are not subjected to a differential pressure of propellant gases while traveling within a gun tube;

wherein the nose is not encapsulated within the sabot;

wherein the plurality of stabilizing fins do not protrude within the cartridge assembly; and wherein after launch from the gun tube, the sabot is discarded, allowing the sub-projectile to travel down-range to a target.

2. The training cartridge of claim 1, wherein the cartridge assembly comprises a cartridge case that contains a propellant.

3. The training cartridge of claim 2 wherein the cartridge assembly further comprises a case adapter positioned intermediate the cartridge case and the projectile assembly.

4. The training cartridge of claim 3 wherein the cartridge assembly further comprises a case base and a seal assembly.

5. The training cartridge of claim 3 wherein the cartridge assembly further comprises a primer.

6. The training cartridge of claim 1, wherein the sabot comprises three petals that disengage and are discarded after launch.

7. The training cartridge of claim 1, wherein the sabot is made, at least in part, of aluminum.

8. The training cartridge of claim 1, wherein the sabot is made, at least in part, of steel.

9. A kinetic energy training cartridge capable of launching a range limiting sub-projectile having a weight less than 3 pounds, allowing the sub-projectile to not exceed approximately an 8000-meter distance when fired at approximately a 10-degree elevation, and to meet a kinetic energy target dispersion requirement of up to approximately 4000 meters, comprising:

a cartridge assembly; and a projectile assembly secured to the cartridge assembly;

wherein the projectile assembly comprises the sub-projectile and a sabot;

wherein the sub-projectile comprises a high drag cone, a projectile rod, and a nose;

wherein the high drag cone is secured to the kinetic energy projectile rod;

wherein the kinetic energy projectile rod is secured to the nose;

wherein the high drag cone and the kinetic energy projectile rod are completely encapsulated in the sabot, so that the high drag cone and the kinetic energy projectile rod are not subjected to a differential pressure of propellant gases while traveling within a gun tube;

wherein the nose is not encapsulated within the sabot;

wherein the high drag cone does not protrude within the cartridge assembly; and wherein after launch from the gun tube, the sabot is discarded, allowing the sub-projectile to travel downrange to a target.

10. The training cartridge of claim 9 wherein the cartridge assembly comprises a cartridge case that contains a propellant.

11. The training cartridge of claim 10 wherein the cartridge assembly further comprises a case adapter positioned intermediate the case and the projectile assembly.

12. The-training cartridge of claim 11 wherein the cartridge assembly further comprises a case base and a seal assembly.

13. The training cartridge of claim 11 wherein the cartridge assembly further comprises a primer.

14. The training cartridge of claim 9 wherein the sabot comprises three petals that disengage and are discarded after launch.

15. The training cartridge of claim 9 wherein the sabot is made, at least in part, of aluminum.

16. The training cartridge of claim 9 wherein the sabot is made, at least in part, of steel.

* * * * *